US005416334A

United States Patent [19]

Knapp et al.

[11] Patent Number: 5,416,334

[45] Date of Patent: May 16, 1995

[54] HOT CELL SHIELD PLUG EXTRACTION APPARATUS

[75] Inventors: Philip A. Knapp, Moore; Larry K. Manhart, Pingree, both of Id.

[73] Assignee: The United States of America as represented by the United States Department of Energy, Washington, D.C.

[21] Appl. No.: 241,908

[22] Filed: May 12, 1994

[51] Int. Cl.[6] ..... G21C 19/00

[52] U.S. Cl. ..... 250/515.1; 250/506.1; 376/203

[58] Field of Search ..... 250/506.1, 515.1, 505.1; 376/203, 272; 976/DIG. 167, DIG. 170, DIG. 179, DIG. 178

[56] References Cited

U.S. PATENT DOCUMENTS

| | | | |
|---|---|---|---|
| 3,801,448 | 4/1974 | Brandstetter et al. | 376/203 |
| 3,920,512 | 11/1975 | Sutherland | 376/203 |
| 4,236,971 | 12/1980 | Winkleback | 376/203 |
| 4,610,839 | 9/1986 | Geier et al. | 250/506.1 |
| 4,866,286 | 9/1989 | Bnatz et al. | 250/506.1 |
| 4,876,593 | 10/1989 | Bauer et al. | 250/515.1 |

*Primary Examiner*—Jack I. Berman
*Assistant Examiner*—James Beyer
*Attorney, Agent, or Firm*—Virginia B. Caress; William R. Moser; Paul A. Gottlieb

[57] ABSTRACT

An apparatus is provided for moving shielding plugs into and out of holes in concrete shielding walls in hot cells for handling radioactive materials without the use of external moving equipment. The apparatus provides a means whereby a shield plug is extracted from its hole and then swung approximately 90 degrees out of the way so that the hole may be accessed. The apparatus uses hinges to slide the plug in and out and to rotate it out of the way, the hinge apparatus also supporting the weight of the plug in all positions, with the load of the plug being transferred to a vertical wall by means of a bolting arrangement.

9 Claims, 2 Drawing Sheets

HOT CELL SHIELD PLUG EXTRACTION APPARATUS

BACKGROUND OF THE INVENTION

A hot cell installation for the handling of highly radioactive material may comprise a dozen or more interconnected high density concrete vaults, the concrete vault walls having a thickness of approximately three feet. Typically, hot cells are constructed in rows so as to share as many shielding walls as possible. Each row has a lead door at each end through which materials can be introduced or removed. The individual vaults, referred to as cells, are separated from adjacent cells by approximately three foot thick shield walls, also of high density concrete, each such separating wall having a large penetration accommodating sliding lead shield doors which permit interconnection of the cells and movement of objects and equipment between cells. These doors allow materials to be moved from cell to cell by use of an inter-cell transfer cart.

The cells are also equipped with leaded glass windows which allow viewing of the internal master-slave manipulators. This arrangement permits the remote handling of radioactive materials inside the cells and also permits the remote movement of optical equipment for detailed viewing of areas in the entire cell interior. The manipulators also allow remote operation of various other pieces of examination, handling, and machining equipment inside the cell. A typical overall length of a row of cells might be 70 yards. Depth of a cell typically ranges between 12 and 16 feet.

The individual hot cells are used for the disassembly, examination, and testing (both nondestructive and destructive) of irradiated nuclear fuel and materials highly contaminated with radioactivity. A typical use of a hot cell might be for optical examination and chemical sampling of spent fuel elements. The hot cells provide the necessary radiation shielding for the personnel outside the hot cells so that they can safely handle these materials.

During the processing of radioactive materials inside a cell, various items must be placed into the cells. In a typical project, materials must be inserted into a cell on average twice in an eight hour shift.

In general, materials have been moved into a cell by two primary methods. In the first method, some hot cells are equipped with water canals under the floor connecting the outside with the inside for this purpose. Underwater carts and elevators accept materials and move them through the water canal to the inside of the cell. The water provides continuous shielding. A second primary mechanism is an opening with a width in the vicinity of one and a half feet equipped with a double lead door mechanism. However, in practice such doors can only be installed in the end cells.

Each of these approaches to allowing materials to enter a hot cell during operations suffered from significant limitations. The first method is of course limited to transferring materials which can be submerged in water without damage or chemical reaction. Water canals are also difficult and expensive to construct and maintain. Moreover, materials often must be moved to or from a cell not connected to a water canal, and there is thus a problem of moving materials from cell to cell after delivery.

The second method is usable in practice only on end cells because of the need for and placement of viewing windows. Thus materials destined for or coming from interior cells must be manipulated remotely to or from the end cell adjacent to the door. The end cells are often blocked from other cells by alpha particle control enclosures in such a way that materials cannot move back and forth between cells.

These methods of introducing and removing materials to and from individual hot cells also suffered from a common shortcoming, namely that they required intricate maneuvering of the material to be inserted and are thus time consuming and exposure prone. It is apparent that if materials could be placed directly in or removed directly from individual hot cells substantial savings in time for operations and personnel exposure to radiation could be achieved.

A secondary mechanism exists for placing certain objects into a cell. This method makes use of approximately 3 inch diameter openings in the concrete filled with removable lead plugs. This method of insertion, though fast, was very limited in that only objects with a profile small enough to pass through a three inch diameter cylinder could enter the hot cell in this way.

More recently, a typical hot cell has been constructed with 8 inch diameter holes through the exterior shielded walls in the vicinity of, and usually above, the viewing windows. Such holes are left in hot cell walls during construction to accommodate later installation of periscopes, remote manipulation equipment, and the like. When the holes are not in use for such equipment, they are filled with steel plugs of approximately the same shielding value as the wall.

It became evident that if the hot cell plugs could be removed and replaced conveniently significant savings in time and personnel exposure could be realized by using these 8 inch holes as entry ports. The high density concrete exterior walls of cells are typically 36 inches thick with a "tenth value" thickness—the thickness of a material that attenuates radiation by a factor of ten—of 10 inches. The attenuation factor of three feet of high density concrete is thus very close to 4000. To obtain a comparable attenuation factor, the steel used for doors and plugs must be about 15 inches in thickness. Fifteen inch cylindrical steel plugs with a diameter of eight inches weigh about two hundred pounds.

Experience has proven that it is possible to use these eight inch holes to introduce a wide variety of materials into individual cells by removing and replacing the eight inch steel plugs. This access method avoids most of the limitations associated with the previous approaches. However, the weight of the plugs has until the present dictated the use of heavy equipment to remove and replace the steel plugs. The only method known up to the present time for moving the plugs out of and back into the holes was by means of a fork lift. This method required four personnel: a hot cell technician, a radiological controls technician, a rigger, and an operator, to work approximately two hours to gain access to a hot cell through a plug. The current invention overcomes these and other limitations of the prior art.

SUMMARY OF THE INVENTION

This invention provides a mechanism to afford ready access to the interiors of hot cells used for manipulating high level radioactive materials. The shield plug swing mechanism comprises a steel shielding plug mounted on a retraction device that enables the plug to be pulled out of the wall and supports the weight of the pulled out plug. The retraction device is mounted on a hinge, which allows the plug to be swung out of the way so that an operator can insert material into or remove it from the interior of the hot cell and then replace the plug quickly. The hinge mounting transmits the load of the retracted plug to the concrete wall.

DESCRIPTION OF PREFERRED EMBODIMENT

The instant invention is a retraction and insertion mechanism for a hot cell shield plug which meets or exceeds all existing shielding requirements. The mechanism provides a quick and easy way to gain access to a hot cell. It achieves this result by mounting the steel plug on a sliding double-door-triple-hinge arrangement.

Figure 1A:
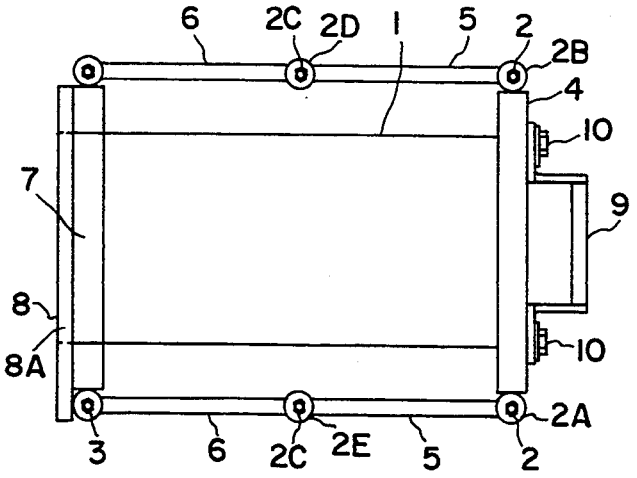
FIGS. 1(*a*), 1(*b*) and 1(*c*) shows plan and elevation views of the swing plug apparatus.
Figure 1B:
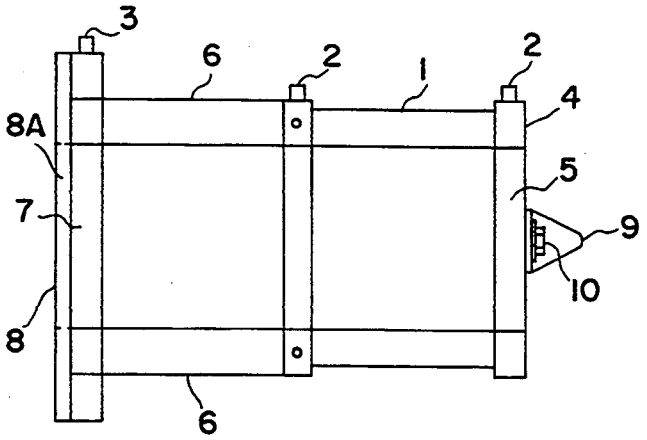
Figure 1C:
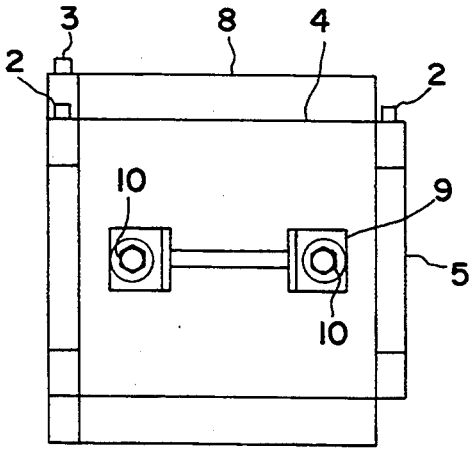

The invention may be more fully understood with reference to FIGS. 1 and 2. The wall plate 8 is mounted to the hot cell wall via four bolts (not shown) passing through four bolt holes (not shown). The wall plate 8 has a hole 8A through which the steel plug 1 can pass in and out. The wall plate 8 transfers the weight of the whole assembly to the wall. A second holed plate 7, called the wall hinge plate, is hinged 3 to the wall plate. The end of the plug 1 is attached to a third plate 4, the plug mounting plate, by two bolts 10 through the handle 9. The plug mounting plate 4 is attached by two hinge pins 2 through hinge cylinders 2A and 2B to hinge bars 5 which are in turn connected to a second hinge arrangement comprising hinge pins 2C and hinge cylinders 2D and 2E. Hinge cylinders 2E are rigidly connected to hinge bars 6 top and bottom, and hinge bars 6 hinge at the opposite ends with the wall hinge plate 7.

Figure 2A:
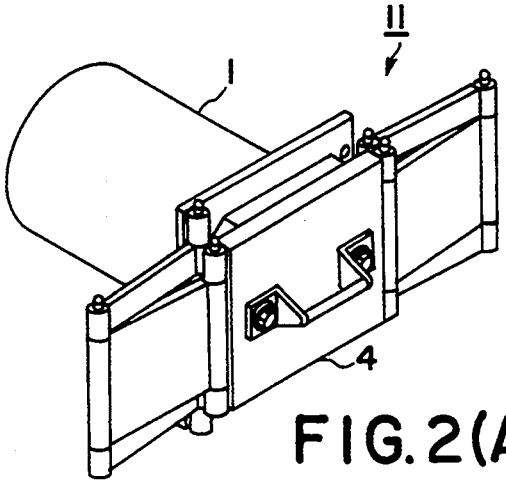
FIGS. 2(*a*), 2(*b*) and 2(*c*) contain isometric views of the swing plug in the fully closed, half open, and fully open positions.
Figure 2B:
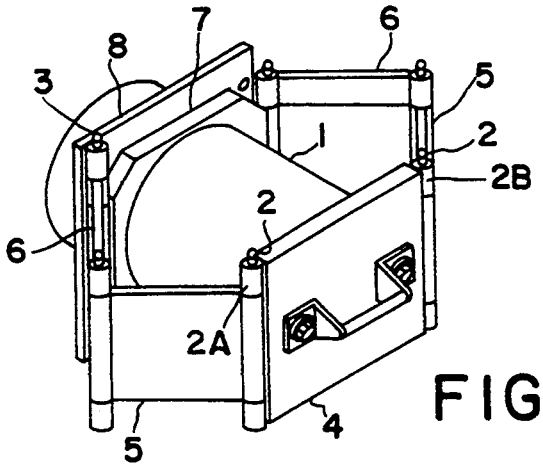
Figure 2C:
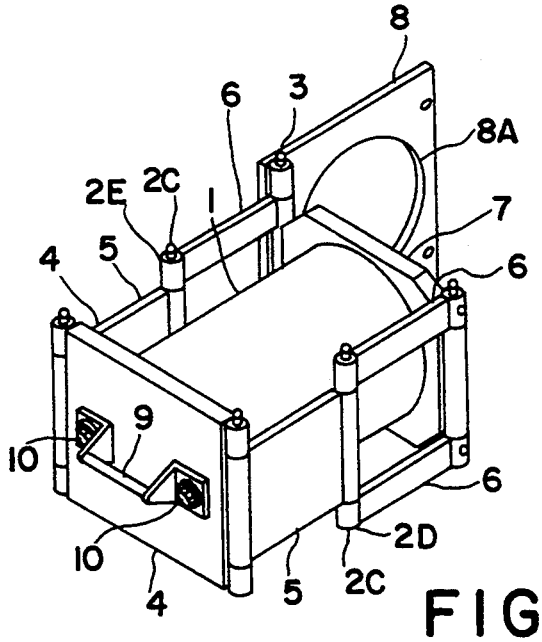

FIG. 2 shows the operation of the device. FIG. 2A depicts the entire mechanism 11 in the fully closed position. In this configuration, the plug 1 is entirely seated in the hole in the concrete shielding wall. The hinges between the plug mounting plate and the hinge bars 5 are fully rotated, as are the hinges between the broad hinge bars 5 and the narrow hinge bars 6 and between the narrow hinge bars 6 and the wall hinge plate 7. In FIG. 2B, the apparatus is half open, showing the plug half in and half out of the hole and the hinges at approximately 45 degrees. In FIG. 2C, the apparatus is depicted in the fully open position. The three hinges connecting the plug mounting plate mechanically to the wall hinge plate are fully extended. The hinge between the wall hinge plate 7 and the wall plate 8 is at approximately 90 degrees, with the plug and its entire mounting apparatus swung out of the way to enable access to the wall hole and the interior of the cell.

We claim:

1. an apparatus for manipulating a heavy object, comprising:

a. the object;

b. a hinged mounting means rigidly attached to the object, said mounting means additionally comprising rigidly attached means for manually moving said mounting means and said object;

c. a pair of first hinge bars hinged to said mounting means;

d. a plurality of second hinge bars hinged to said first hinge bars;

e. a vertical hinge means hinged to said plurality of second hinge bars said hinged mounting means, said pair of first hinge bars hinged to said mounting means, said plurality of second hinge bars hinged to said first hinge bars, and said vertical hinge means hinged to said plurality of second hinge bars collectively comprising a structurally rigid collapsible cage whereby said object is movable reversibly in an axial direction inside said cage while the cage supports the weight of the object; and f. a vertical mounting means hinged at one side of said cage to said vertical hinge means, whereby said cage is rotatable approximately 90 degrees about a vertical axis, said vertical mounting means having a vertical mounting plate and means for attaching said vertical mounting plate, and thereby the entire apparatus, rigidly to a vertical structure.

2. A retraction and insertion swing mechanism for a hot cell shield plug comprising a steel shielding plug mounted on a retraction device that enables the plug to be retracted from a wall of a hot cell with the mechanism supporting the weight of the retracted plug, said retraction and insertion mechanism being mounted on a hinge, said hinge being attached to a wall mounting means, said hinge allowing the retracted plug to be swung out of the way whereby a hot cell operator can insert material into or remove it from the hot cell and then replace the plug, said wall mounting means transmitting the load of the retracted plug to the hot cell wall.

3. An apparatus for reversibly plugging an opening in a wall with heavy plugs, said apparatus comprising:

a. a plug;

b. a hinged mounting means rigidly attached to said plug, said mounting means additionally comprising rigidly attached means for manually moving said mounting means and said plug axially;

c. a pair of first hinge bars hinged to said mounting means;

d. a plurality of second hinge bars hinged to said first hinge bars;

c. a wall hinge means hinged to said plurality of second hinge bars, said hinge means having an opening with a shape approximately congruent with the shape of said plug and of sufficient dimension so that said plug can pass through said opening, said hinged mounting means, said pair of first hinge bars hinged to said mounting means, said plurality of second hinge bars hinged to said first hinge bars, and said wall hinge means hinged to said plurality of second hinge bars collectively comprising a structurally rigid collapsible cage whereby said plug is moved reversibly in an axial direction inside said cage while the cage supports the weight of the plug; and f. a wall mounting means comprising a wall mounting plate hinged at one side of said cage to said wall hinge means, whereby said cage is rotatable approximately 90 degrees about a vertical axis, said wall mounting plate also having an opening with a shape approximately congruent with the shape of said plug and of sufficient dimension so that said plug can pass through said opening, said wall mounting plate also having means for attaching said wall mounting plate, and thereby the collapsible cage and the plug, rigidly and coaxially to a vertical wall containing an opening approximately congruent with the openings in said wall hinge means and said wall mounting plate.

4. The apparatus of claim 3 in which said plug comprises a steel cylinder of a thickness sufficient to provide shielding from radiation approximately equivalent to that of the wall in which said plug is installed.

5. The apparatus of claim 3 in which said hinged mounting means is a steel plate.

6. The apparatus of claim 3 in which said means for manually moving said mounting means is a handle rigidly attached to said mounting means.

7. The apparatus of claim 3 in which said first and second hinge bars are fabricated from steel.

8. The apparatus of claim 3 in which said wall hinge means is a steel plate.

9. The apparatus of claim 3 in which said wall mounting means is a steel plate.

* * * * *